US008685212B2

(12) United States Patent
Tanaka et al.

(10) Patent No.: US 8,685,212 B2
(45) Date of Patent: Apr. 1, 2014

(54) STARTING-UP METHOD OF FRACTIONATOR

(75) Inventors: Yuichi Tanaka, Yokohama (JP); Hidekatsu Honda, Tokyo (JP)

(73) Assignees: JX Nippon Oil & Energy Corporation, Tokyo (JP); Japan Oil, Gas and Metals National Corporation, Kanagawa (JP); Inpex Corporation, Tokyo (JP); Japan Petroleum Exploration Co., Ltd., Tokyo (JP); Cosmo Oil Co., Ltd., Tokyo (JP); Nippon Steel Engineering Co., Ltd., Tokyo (JP)

( * ) Notice: Subject to any disclaimer, the term of this patent is extended or adjusted under 35 U.S.C. 154(b) by 366 days.

(21) Appl. No.: 12/998,199

(22) PCT Filed: Sep. 25, 2009

(86) PCT No.: PCT/JP2009/004872

§ 371 (c)(1),
(2), (4) Date: May 2, 2011

(87) PCT Pub. No.: WO2010/038389

PCT Pub. Date: Apr. 8, 2010

(65) Prior Publication Data

US 2011/0210046 A1 Sep. 1, 2011

(30) Foreign Application Priority Data

Sep. 30, 2008 (JP) ..... 2008-254221

(51) Int. Cl.
*B01D 3/14* (2006.01)

(52) U.S. Cl.
USPC ..... 203/87; 203/98; 208/347; 208/950; 518/728; 585/911; 585/951

(58) Field of Classification Search
USPC ..... 208/347, 362, 369, 370, 950; 585/911, 585/951; 203/87, 98, DIG. 7; 518/728
See application file for complete search history.

(56) References Cited

U.S. PATENT DOCUMENTS 2,609,274 A * 9/1952 Russum et al. ..... 423/655
2,939,293 A * 6/1960 Green ..... 62/628

(Continued)

FOREIGN PATENT DOCUMENTS

AU 2007232926 B1 * 11/2010 ..... C10L 1/04
CN 2562831 Y 7/2003

(Continued)

OTHER PUBLICATIONS

International Search Report dated Oct. 20, 2009 issued in corresponding PCT Application No. PCT/JP2009/004872.

(Continued)

*Primary Examiner* — Nina Bhat
*Assistant Examiner* — Jonathan Miller
(74) *Attorney, Agent, or Firm* — Kenyon & Kenyon LLP

(57) ABSTRACT

A start-up method of a fractionator which fractionally distills FT synthesized hydrocarbons produced by the Fischer-Tropsch synthesis reaction, the method includes: discharging light FT synthesized hydrocarbons which exist in a gaseous state in an FT reactor performing the Fischer-Tropsch synthesis reaction from the FT reactor to the outside; cooling down the light FT synthesized hydrocarbons discharged from the FT reactor for liquefaction; supplying the liquefied light FT synthesized hydrocarbons to the fractionator; and heating the light FT synthesized hydrocarbons and circulating the light FT synthesized hydrocarbons to the fractionator.

5 Claims, 4 Drawing Sheets

(56) References Cited

U.S. PATENT DOCUMENTS

| | | | | |
|---|---|---|---|---|
| 4,127,392 | A * | 11/1978 | Watson et al. | 48/197 R |
| 6,958,364 | B1 | 10/2005 | MacPherson et al. | |
| 7,855,236 | B2 * | 12/2010 | Van Hardeveld et al. | 518/706 |
| 2004/0077736 | A1 * | 4/2004 | Steynberg et al. | 518/703 |
| 2005/0027020 | A1 * | 2/2005 | Steynberg | 518/718 |
| 2008/0275144 | A1 * | 11/2008 | Van Hardeveld et al. | 518/706 |

FOREIGN PATENT DOCUMENTS

| | | | | |
|---|---|---|---|---|
| EP | 0 187 030 | | 7/1986 | |
| JP | 61-167402 | | 7/1986 | |
| JP | 2003-135902 | | 5/2003 | |
| JP | 2004-323626 | | 11/2004 | |
| JP | 2008-506817 | | 3/2008 | |
| JP | 2010083998 | A * | 4/2010 | C10G 45/02 |
| JP | 2011208004 | A * | 10/2011 | C10G 65/14 |
| WO | WO 2007/069197 | | 6/2007 | |
| WO | WO 2007/114277 | | 10/2007 | |

OTHER PUBLICATIONS

Chinese Office Action dated Mar. 22, 2013, issued in corresponding Chinese Application No. 200980138076.8, with an English translation of the Search Report only.

* cited by examiner

STARTING-UP METHOD OF FRACTIONATOR

TECHNICAL FIELD

The present invention relates to a method for starting-up a fractionator which fractionally distills FT synthesized hydrocarbons produced by the Fischer-Tropsch synthesis reaction.

This application is a national stage application of International Application No. PCT/JP2009/004872, filed Sep. 25, 2009, which claims priority to Japanese Patent Application No. 2008-254221, filed Sep. 30, 2008, the content of which is incorporated herein by reference.

BACKGROUND ART

As one of the methods for synthesizing liquid fuels from a natural gas, a GTL (Gas To Liquids: liquid fuel synthesis) technique of reforming a natural gas to produce a synthesis gas containing a carbon monoxide gas (CO) and a hydrogen gas ($H_2$) as the main components, synthesizing hydrocarbons using this synthesis gas as a source gas by the Fischer-Tropsch synthesis reaction (hereinafter, in some cases, referred to as "FT synthesis reaction"), and further hydrogenating and refining the hydrocarbons to produce liquid fuel products, such as naphtha (raw gasoline), kerosene, gas oil, and wax, has recently been developed.

Here, since the liquid fuel products obtained from the FT synthesis hydrocarbons obtained by the FT synthesis reaction as a feedstock have high paraffin content, and hardly include any sulfur components as shown, for example, in Patent Document 1, they have been paid attention to as a fuel which is compatible with the environment.

Further, the FT synthesis hydrocarbons supplied to a fractionator, for example, as shown in Patent Document 2, are fractionally distilled according to boiling points, and the fractionally distilled hydrocarbons are then obtained from discharge ports respectively provided at the upper part, middle part, and lower part of the fractionator.

CITATION LIST

Patent Document

[Patent Document 1] Japanese Patent Unexamined Publication No. 2004-323626

[Patent Document 2] Japanese Patent Unexamined Publication No. S61-167402

SUMMARY OF THE INVENTION

Problem that the Invention is to Solve

Meanwhile, in the above-described fractionator, when heavy hydrocarbons with high melting points are supplied in a state where the temperature is low, the heavy hydrocarbons are solidified, and their fluidity is lost. As a result, fractional distillation will not be able to be performed. For this reason, the inside of the fractionator is filled with light hydrocarbons equivalent to gas oil (carbon number of about 11 to 20) at the time of start-up of the fractionator, and the hydrocarbons are heated by a heat exchanger provided outside the fractionator and are circulated to the inside of the fractionator to perform a warm-up operation so that the inside of the fractionator is heated up to a predetermined temperature.

Thus, when such hydrocarbons equivalent to gas oil are charged, it is necessary to provide a tank, or the like, for the hydrocarbons equivalent to gas oil at the time of start-up. Further, since the hydrocarbons which are generally obtained contain sulfur (S) at least in the order of ppm, there is a possibility that the catalyst in a refining reactor which refines the fractionally distilled FT synthesized hydrocarbons may become poisoned. Moreover, since the sulfur (S) will be mixed into products when the hydrocarbons equivalent to gas oil are mixed into the products, it is necessary to reliably slop out the hydrocarbons.

The present invention was made in view of the aforementioned situation and the object thereof is to provide a start-up method of a fractionator which can warm-up a fractionator for operation without using the hydrocarbons equivalent to gas oil obtained from an external source, and can obtain high-quality liquid fuels without the concern of incorporating sulfur (S) when a warm-up operation of the fractionator which fractionally distills FT synthesized hydrocarbons obtained by the FT synthesis reaction is performed.

Means for Solving the Problem

In order to solve the above-mentioned problems and achieve such an object, the present invention proposes the following means.

The start-up method of a fractionator according to the present invention is a start-up method of a fractionator which fractionally distills FT synthesized hydrocarbons produced by the FT synthesis reaction. The method includes: discharging light FT synthesized hydrocarbons which exist in a gaseous state in an FT reactor performing the Fischer-Tropsch synthesis reaction from the FT reactor to the outside; cooling down the light FT synthesized hydrocarbons discharged from the FT reactor for liquefaction; supplying the liquefied light FT synthesized hydrocarbons to the fractionator; and heating the light FT synthesized hydrocarbons and circulating the light FT synthesized hydrocarbons to the fractionator.

According to the start-up method of a fractionator having the above configuration, the light FT synthesized hydrocarbons which exist in a gaseous state in the FT reactor are discharged, cooled down and liquefied, charged into a fractionator, and the light FT synthesized hydrocarbons are circulated while being heated. Thus, a warm-up operation of the fractionator can be performed without using liquid hydrocarbons equivalent to gas oil obtained from an external source. Accordingly, it is not necessary to provide a tank, or the like, for hydrocarbons equivalent to gas oil. Further, since the light FT synthesized hydrocarbons obtained by the FT synthesis hardly include any sulfur components, there is no possibility that the catalyst in the refining reactor, which refines the fractionally distilled FT synthesized hydrocarbons, is poisoned, and thus liquid fuels, such as naphtha, gas oil, and kerosene, can be efficiently obtained. Moreover, since the light FT synthesized hydrocarbons, which are originally a feedstock fed to a hydrotreating reactor, have no problems in being hydrotreated, even if being mixed into a product, it is not necessary to separate and slop out the light FT synthesized hydrocarbons.

The discharge of the light FT synthesized hydrocarbons from the FT reactor may be started before extracting of the heavy FT synthesized hydrocarbons which exist in a liquid state in the FT reactor.

In this case, after the light synthesized hydrocarbons are discharged from the FT reactor and a warm-up operation of the fractionator is performed, the heavy FT synthesized hydrocarbons are supplied to the fractionator. As a result, fractional distillation in the fractionator can be reliably and efficiently performed. Further, the heavy FT synthesized hydrocarbons with a large carbon number can be kept from being mixed into the light FT synthesized hydrocarbons, and the fluidity of the light FT synthesized hydrocarbons can be secured.

Further, the surface level in the FT reactor at the time of start-up may be set to be lower than the surface level in the FT reactor during normal operation.

In this case, by setting the surface level in the FT reactor to be lower than that during normal operation, extraction of the heavy FT synthesized hydrocarbons is not started until the heavy FT synthesized hydrocarbons arrive at the surface level of the FT reactor during normal operation even if the heavy FT synthesized hydrocarbons are produced. However, the light FT synthesized hydrocarbons, which are in a gaseous state, are discharged from a discharge port at the top of the FT reactor from the initial stage of the FT reaction. That is, a time difference can be made between the start of the discharge of the light FT synthesized hydrocarbons from the FT reactor, and the start of the extraction of the heavy FT synthesized hydrocarbons. In addition, it is preferable that the surface level at the time of start-up is lowered in consideration of the required feed amount of the light FT synthesized hydrocarbons to the fractionator. For example, it is preferable to set the surface level at the time of start-up to be about 60 to 70% of that during normal operation.

Moreover, an unreacted source gas mixed into the light FT synthesized hydrocarbons which exist in a gaseous state in the FT reactor may be discharged from the FT reactor, and the unreacted source gas may be flowed back to the FT reactor.

Within the FT reactor, the unreacted source gas (synthesis gas of a carbon monoxide and a hydrogen) is mixed into the light FT synthesized hydrocarbons which exist in a gaseous state within the FT reactor. By making this source gas flow back to the FT reactor, the productivity of the hydrocarbons by the FT synthesis reaction can be improved.

Further, the method may further include removing water included in the light FT synthesized hydrocarbons.

Since water (steam) is produced as a byproduct in the FT reactor, a steam is also included in the light FT synthesized hydrocarbons, which exist in a gaseous state in the FT reactor. Therefore, the mixing of the water into the fractionator can be prevented by providing a water removal configuration.

Advantage of the Invention

According to the present invention, when a warm-up operation of a fractionator which fractionally distills the FT synthesis hydrocarbons obtained by the FT synthesis reaction is performed, it is possible to provide a start-up method of a fractionator which can warm-up the fractionator for operation without using the hydrocarbons equivalent to gas oil obtained from an external source, and can obtain high-quality liquid fuels without the concern of incorporating any sulfur (S) components.

DESCRIPTION OF EMBODIMENT

Hereinafter, preferred embodiments of the present invention will be described with reference to the accompanying drawings.

First, with reference to FIG. 1, the overall configuration and process of a liquid-fuel synthesizing system (hydrocarbon synthesis reaction system) where a start-up method of a fractionator which is an embodiment of the present invention is used will be described.

Figure 1:
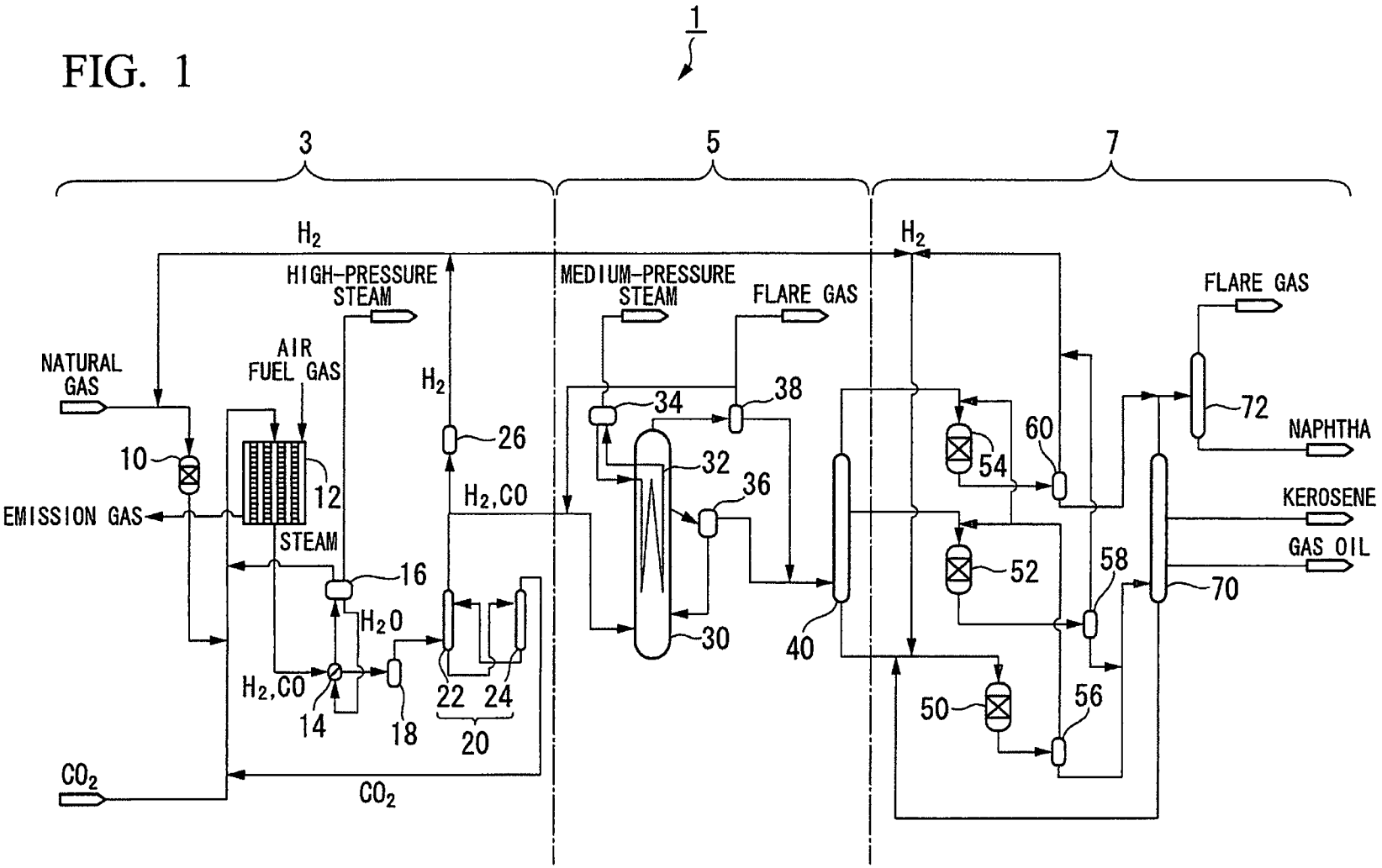
FIG. 1 is a schematic diagram showing the overall configuration of a liquid-fuel synthesizing system including fractionators (a first fractionator, a second fractionator) according to an embodiment of the present invention.

As shown in FIG. 1, a liquid fuel synthesizing system (hydrocarbon synthesis reaction system) 1 according to the embodiment is a plant facility for carrying out a GTL process which converts a hydrocarbon feedstock such as a natural gas and the like to liquid fuels. The liquid fuel synthesizing system 1 is configured with a synthesis gas production unit 3, a FT synthesis unit 5, and a product upgrading unit 7.

In the synthesis gas production unit 3, a natural gas which is a hydrocarbon feedstock is reformed to produce a synthesis gas containing a carbon monoxide gas and a hydrogen gas.

In the FT synthesis unit 5, the produced synthesis gas is subjected to FT synthesis reaction to produce liquid hydrocarbons (FT synthesized hydrocarbons).

In the product upgrading unit 7, the liquid hydrocarbons (FT synthesized hydrocarbons) produced by the FT synthesis reaction are subjected to hydroprocessing and a fractional distillation to produce liquid fuel products (naphtha, kerosene, gas oil, wax, and the like). Components which configure each unit will be described below.

The synthesis gas production unit 3 mainly includes, for example, a desulfurizing reactor 10, a reformer 12, a waste heat boiler 14, vapor-liquid separators 16 and 18, a $CO_2$ removal unit 20, and a hydrogen separator 26. The desulfurizing reactor 10 is composed of a hydrodesulfurizer, etc., and removes sulfur components from a natural gas as a feedstock. The reformer 12 reforms the natural gas supplied from the desulfurizing reactor 10, to produce a synthesis gas including a carbon monoxide gas (CO) and a hydrogen gas ($H_2$) as the main components. The waste heat boiler 14 recovers waste heat of the synthesis gas produced in the reformer 12, to produce a high-pressure steam. The vapor-liquid separator 16 separates the water heated by heat exchange with the synthesis gas in the waste heat boiler 14 into a vapor (high-pressure steam) and a liquid. The vapor-liquid separator 18 removes a condensate from the synthesis gas cooled down in the waste heat boiler 14, and supplies a gas component to the $CO_2$ removal unit 20. The $CO_2$ removal unit 20 has an absorption tower 22 which removes a carbon dioxide gas by using an absorbent from the synthesis gas supplied from the vapor-liquid separator 18, and a regeneration tower 24 which desorbs the carbon dioxide gas and regenerates the absorbent including the carbon dioxide gas. The hydrogen separator 26 separates a portion of the hydrogen gas included in the synthesis gas, the carbon dioxide gas of which has been separated by the $CO_2$ removal unit 20. It is to be noted herein that the above $CO_2$ removal unit 20 is not necessarily provided depending on circumstances.

The FT synthesis unit 5 is composed of, for example, a bubble column reactor (bubble column hydrocarbon synthesis reactor) 30, a vapor-liquid separator 34, a separator 36, a vapor-liquid separator 38, and a first fractionator 40.

The bubble column reactor 30 is an example of a reactor which synthesizes liquid hydrocarbons (FT synthesized hydrocarbons) from a synthesis gas and performs as an FT synthesis reactor which synthesizes liquid hydrocarbons (FT synthesized hydrocarbons) from a synthesis gas by an FT synthesis reaction.

The bubble column reactor 30 is configured as, for example, a bubble column slurry bed reactor in which a slurry made by suspending solid catalyst particles in the liquid hydrocarbons (FT synthesized hydrocarbons) is contained. The bubble column reactor 30 makes the synthesis gas (a carbon monoxide gas and a hydrogen gas) produced by the synthesis gas production unit undergo a reaction to synthesize liquid hydrocarbons (FT synthesized hydrocarbons).

The vapor-liquid separator 34 separates a vapor (medium-pressure steam) and a liquid from water circulated and heated in a heat transfer tube 32 arranged inside the bubble column reactor 30.

The separator 36 separates catalyst particles and liquid hydrocarbons (FT synthesized hydrocarbons) from the slurry contained in the bubble column reactor 30.

The vapor-liquid separator 38 is connected to the top of the bubble column reactor 30 and cools down an unreacted synthesis gas and a gas component of FT synthesized hydrocarbons.

The first fractionator 40 distills the liquid hydrocarbons (FT synthesized hydrocarbons) supplied from the bubble column reactor 30 via the separator 36 and the vapor-liquid separator 38 and fractionates the liquid hydrocarbons (FT synthesized hydrocarbons) into each fraction according to boiling points.

The product upgrading unit 7 is composed of, for example, a wax fraction hydrocracking reactor 50, a middle distillate hydrotreating reactor 52, a naphtha fraction hydrotreating reactor 54, vapor-liquid separators 56, 58, and 60, a second fractionator 70, and a naphtha stabilizer 72.

The wax fraction hydrocracking reactor 50 is connected to the bottom of the first fractionator 40 and the vapor-liquid separator 56 is disposed in the downstream of the reactor. A catalyst for promoting a reaction is used in the wax fraction hydrocracking reactor 50.

The middle distillate hydrotreating reactor 52 is connected to the middle part of the first fractionator 40 and the vapor-liquid separator 58 is disposed in the downstream of the reactor. A catalyst for promoting a reaction is used in the middle distillate hydrotreating reactor 52.

The naphtha fraction hydrotreating reactor 54 is connected to the upper part of the first fractionator 40 and the vapor-liquid separator 60 is disposed in the downstream of the reactor. A catalyst for promoting a reaction is used in the naphtha fraction hydrotreating reactor 54.

The second fractionator 70 fractionally distills the liquid hydrocarbons (FT synthesized hydrocarbons) supplied from the vapor-liquid separators 56 and 58 according to boiling points.

The naphtha stabilizer 72 fractionates the liquid hydrocarbons (FT synthesized hydrocarbons) of naphtha fractions supplied from the vapor-liquid separator 60 and the second fractionator 70, discharges butane and components lighter than butane as a flare gas (emission gas), and separates and recovers components having 5 carbon atoms or more as a naphtha product.

Next, a process (GTL process) of synthesizing liquid fuels from a natural gas by the liquid-fuel synthesizing system 1 configured as above will be described.

A natural gas (whose main component is $CH_4$) as a hydrocarbon feed stock is supplied to the liquid fuel synthesizing system 1 from an external natural gas supply source (not shown), such as a natural gas field or a natural gas plant. The above synthesis gas production unit 3 reforms this natural gas to produce a synthesis gas (mixed gas including a carbon monoxide gas and a hydrogen gas as the main components).

First, the above natural gas is supplied to the desulfurizing reactor 10 along with the hydrogen gas separated by the hydrogen separator 26. The desulfurizing reactor 10 hydrogenates and desulfurizes sulfur components included in the natural gas using the hydrogen gas, with, for example, a ZnO catalyst. By desulfurizing the natural gas in advance in this way, it is possible to prevent deactivation of catalysts used in the reformer 12, the bubble column reactor 30, etc. by sulfur compounds.

The natural gas desulfurized in this way is supplied to the reformer 12 after the carbon dioxide ($CO_2$) gas supplied from a carbon-dioxide supply source (not shown) and the steam generated in the waste heat boiler 14 are mixed therewith. The reformer 12 reforms the natural gas by using a carbon dioxide and a steam to produce a high-temperature synthesis gas including a carbon monoxide gas and a hydrogen gas as the main components by a steam and carbon-dioxide-gas reforming method.

The high-temperature synthesis gas (for example, 900° C., 2.0 MPaG) produced in the reformer 12 in this way is supplied to the waste heat boiler 14, and is cooled down by the heat exchange with the water which flows through the waste heat boiler 14 (for example, 400° C.), thus the waste heat is recovered. At this time, the water heated by the synthesis gas in the waste heat boiler 14 is supplied to the vapor-liquid separator 16. From this vapor-liquid separator 16, a gas component is supplied to the reformer 12 or other external devices as a high-pressure steam (for example, 3.4 to 10.0 MPaG), and water as a liquid component is returned to the waste heat boiler 14.

Meanwhile, the synthesis gas cooled down in the waste heat boiler 14 is supplied to the absorption tower 22 of the $CO_2$ removal unit 20, or the bubble column reactor 30, after a condensate is separated and removed from the synthesis gas in the vapor-liquid separator 18. The absorption tower 22 absorbs a carbon dioxide gas included in the synthesis gas into the retained absorbent, to separate the carbon dioxide gas from the synthesis gas. The absorbent including the carbon dioxide gas within this absorption tower 22 is introduced into the regeneration tower 24, the absorbent including the carbon dioxide gas is heated and subjected to stripping treatment with, for example, a steam, and the resulting desorbed carbon dioxide gas is recycled to the reformer 12 from the regeneration tower 24, and is reused for the above reforming reaction.

The synthesis gas produced in the synthesis gas production unit 3 in this way is supplied to the bubble column reactor 30 of the above the FT synthesis unit 5. At this time, the composition ratio of the synthesis gas supplied to the bubble column reactor 30 is adjusted to a composition ratio (for example, $H_2$:CO=2:1 (molar ratio)) suitable for the FT synthesis reaction.

The portion of the synthesis gas, the carbon dioxide gas of which has been separated by the above $CO_2$ removal unit 20, is also supplied to the hydrogen separator 26. The hydrogen separator 26 separates the hydrogen gas included in the synthesis gas, by adsorption and desorption (hydrogen PSA) utilizing a pressure difference. This separated hydrogen is continuously supplied from a gas holder (not shown), etc. via a compressor (not shown) to various hydrogen-utilizing reaction devices (for example, the desulfurizing reactor 10, the wax fraction hydrocracking reactor 50, the middle distillate hydrotreating reactor 52, the naphtha fraction hydrotreating reactor 54, etc.) which perform predetermined reactions utilizing hydrogen within the liquid fuel synthesizing system 1.

Next, the above FT synthesis unit 5 synthesizes liquid hydrocarbons (FT synthesized hydrocarbons) by the FT synthesis reaction from the synthesis gas produced by the above synthesis gas production unit 3.

The synthesis gas produced in the synthesis gas production unit 3 flows in from the bottom of the bubble column reactor 30, and flows up in the catalyst slurry contained in the bubble column reactor 30. At this time, within the bubble column reactor 30, the carbon monoxide gas and hydrogen gas which are included in the synthesis gas react with each other by the FT synthesis reaction, thereby producing liquid hydrocarbons (FT synthesized hydrocarbons). Moreover, by flowing water through the heat transfer pipe 32 of the bubble column reactor 30 at the time of this synthesis reaction, the reaction heat of the FT synthesis reaction is removed, and the water heated by this heat exchange is vaporized into a steam. As for this steam, the water liquefied in the vapor-liquid separator 34 is returned to the heat transfer pipe 32, and a gas component is supplied to an external device as a medium-pressure steam (for example, 1.0 to 2.5 MPaG).

The liquid hydrocarbons (FT synthesized hydrocarbons) synthesized in the bubble column reactor 30 are introduced into the separator 36 as a slurry with catalyst particles. The separator 36 separates solid components such as the catalyst particles and the like and liquid components containing the liquid hydrocarbons (FT synthesized hydrocarbons) from the slurry. A part of the separated catalyst is supplied to the bubble column reactor 30, and the liquid component is supplied to the first fractionator 40. From the top of the bubble column reactor 30, the unreacted synthesis gas, and the gas component of the FT synthesized hydrocarbons are introduced into the vapor-liquid separator 38. The vapor-liquid separator 38 cools down these gases to separate some condensed liquid hydrocarbons (FT synthesized hydrocarbons) to introduce them into the first fractionator 40. Meanwhile, as for the gas component separated in the vapor-liquid separator 38, the unreacted synthesis gas (CO and $H_2$) is returned to the bottom of the bubble column reactor 30, and is reused for the FT synthesis reaction. Further, the emission gas (flare gas) other than the target products, including as the main component hydrocarbon gas having a small carbon number ($C_4$ or less), is introduced into an external combustion facility (not shown), is combusted therein, and is then emitted to the atmosphere.

Next, the first fractionator 40 heats the FT synthesized hydrocarbons (whose carbon numbers are various) supplied via the separator 36 and the vapor-liquid separator 38 from the bubble column reactor 30 as described above, to fractionally distill the FT synthesized hydrocarbons utilizing a difference in boiling points. Thereby, the first fractionator 40 separates and refines the FT synthesized hydrocarbons into a naphtha fraction (whose boiling point is lower than about 150° C.), a middle distillate (corresponding to kerosene and gas oil fraction, whose boiling point is about 150 to 350° C.), and a wax fraction (whose boiling point is higher than about 350° C.).

The FT synthesized hydrocarbons (mainly $C_{21}$ or more) as the wax fraction drawn from the bottom of the first fractionator 40 are brought into to the wax fraction hydrocracking reactor 50, the FT synthesized hydrocarbons (mainly $C_{11}$ to $C_{20}$) as the middle distillate drawn from the middle part of the first fractionator 40 are brought into the middle distillate hydrotreating reactor 52, and the FT synthesized hydrocarbons (mainly $C_5$ to $C_{10}$) as the naphtha fraction drawn from the upper part of the first fractionator 40 are brought into the naphtha fraction hydrotreating reactor 54.

The wax fraction hydrocracking reactor 50 hydrocracks the FT synthesized hydrocarbons as the wax fraction with a large carbon number (approximately $C_{21}$ or more), which has been supplied from the bottom of the first fractionator 40, by using the hydrogen gas supplied from the above hydrogen separator 26, to reduce the carbon number to $C_{20}$ or less. In this hydrocracking reaction, hydrocarbons with a small carbon number and with low molecular weight are produced by cleaving the C—C bonds of the hydrocarbons with a large carbon number, using a catalyst and heat. A product including the liquid hydrocarbons hydrocracked in this wax fraction hydrocracking reactor 50 is separated into a gas and a liquid in the vapor-liquid separator 56, the liquid hydrocarbons of which are brought into the second fractionator 70, and the gas component (including hydrogen gas) of which is brought into the middle distillate hydrotreating reactor 52 and the naphtha fraction hydrotreating reactor 54.

The middle distillate hydrotreating reactor 52 hydrotreats FT synthesized hydrocarbons (approximately $C_{11}$ to $C_{20}$) as the middle distillate having a substantially medium carbon number, which have been supplied from the middle part of the first fractionator 40, by using the hydrogen gas supplied via the wax fraction hydrocracking reactor 50 from the hydrogen separator 26. In this hydrotreating reaction, in order to obtain mainly branched chain saturated hydrocarbons, the liquid hydrocarbons are isomerized, and a hydrogen is added to unsaturated bonds of the above liquid hydrocarbons to saturate the liquid hydrocarbons. As a result, a product including the hydrotreated liquid hydrocarbons is separated into a gas and a liquid in the vapor-liquid separator 58, the liquid hydrocarbons of which are brought into the second fractionator 70, and the gas component (including hydrogen gas) of which is reused for the above hydrogenation reaction.

The naphtha fraction hydrotreating reactor 54 hydrotreats FT synthesized hydrocarbons (approximately $C_{10}$ or less) as the naphtha fraction with a low carbon number, which have been supplied from the upper part of the first fractionator 40, by using the hydrogen gas supplied via the wax fraction hydrocracking reactor 50 from the hydrogen separator 26. As a result, a product (hydrogenated naphtha) including the hydrotreated liquid hydrocarbons are separated into a gas and a liquid in the vapor-liquid separator 60, the liquid hydrocarbons of which are transferred to the naphtha stabilizer 72, and the gas component (including hydrogen gas) of which is reused for the above hydrogenation reaction.

Next, the second fractionator 70 distills the FT synthesized hydrocarbons supplied from the wax fraction hydrocracking reactor 50 and the middle distillate hydrotreating reactor 52 as described above to fractionate them into hydrocarbons (whose boiling point is lower than about 150° C.) with a carbon number of $C_{10}$ or less, kerosene (whose boiling point is about 150 to 250° C.), gas oil (whose boiling point is about 250 to 350° C.), and uncracked wax fraction from the wax fraction hydrocracking reactor 50 (whose boiling point is higher than about 350° C.). The uncracked wax fraction is obtained from the bottom of the second fractionator 70 and returned to the upstream of the wax fraction hydrocracking reactor 50. The gas oil is drawn from a lower part of the second fractionator 70, and the kerosene is drawn from a middle part thereof. Meanwhile, a hydrocarbon gas with a carbon number of $C_{10}$ or less is drawn from the top of the second fractionator 70, and is supplied to the naphtha stabilizer 72.

Moreover, the naphtha stabilizer 72 distills the hydrocarbons with a carbon number of $C_{10}$ or less, which have been supplied from the above naphtha fraction hydrotreating reactor 54 and second fractionator 70 to fractionate naphtha ($C_5$ to $C_{10}$) as a product. Accordingly, high-purity naphtha is drawn from a lower part of the naphtha stabilizer 72. Meanwhile, the emission gas (flare gas) other than the product, which contains as the main component hydrocarbons with a predetermined carbon number or less ($C_4$ or less), is discharged from the top of the naphtha stabilizer 72. The emission gas (flare gas) is introduced to the outside combustion facilities (not shown in the drawing) and burned, thereby being discharged to the atmosphere.

The process (GTL process) of the liquid fuel synthesizing system 1 has been described above. By the GTL process concerned, a natural gas is converted to fuels, such as high-purity naphtha ($C_5$ to $C_{10}$: raw gasoline), kerosene ($C_{11}$ to $C_{16}$), and gas oil ($C_{16}$ to $C_{20}$: diesel oil).

Figure 2:
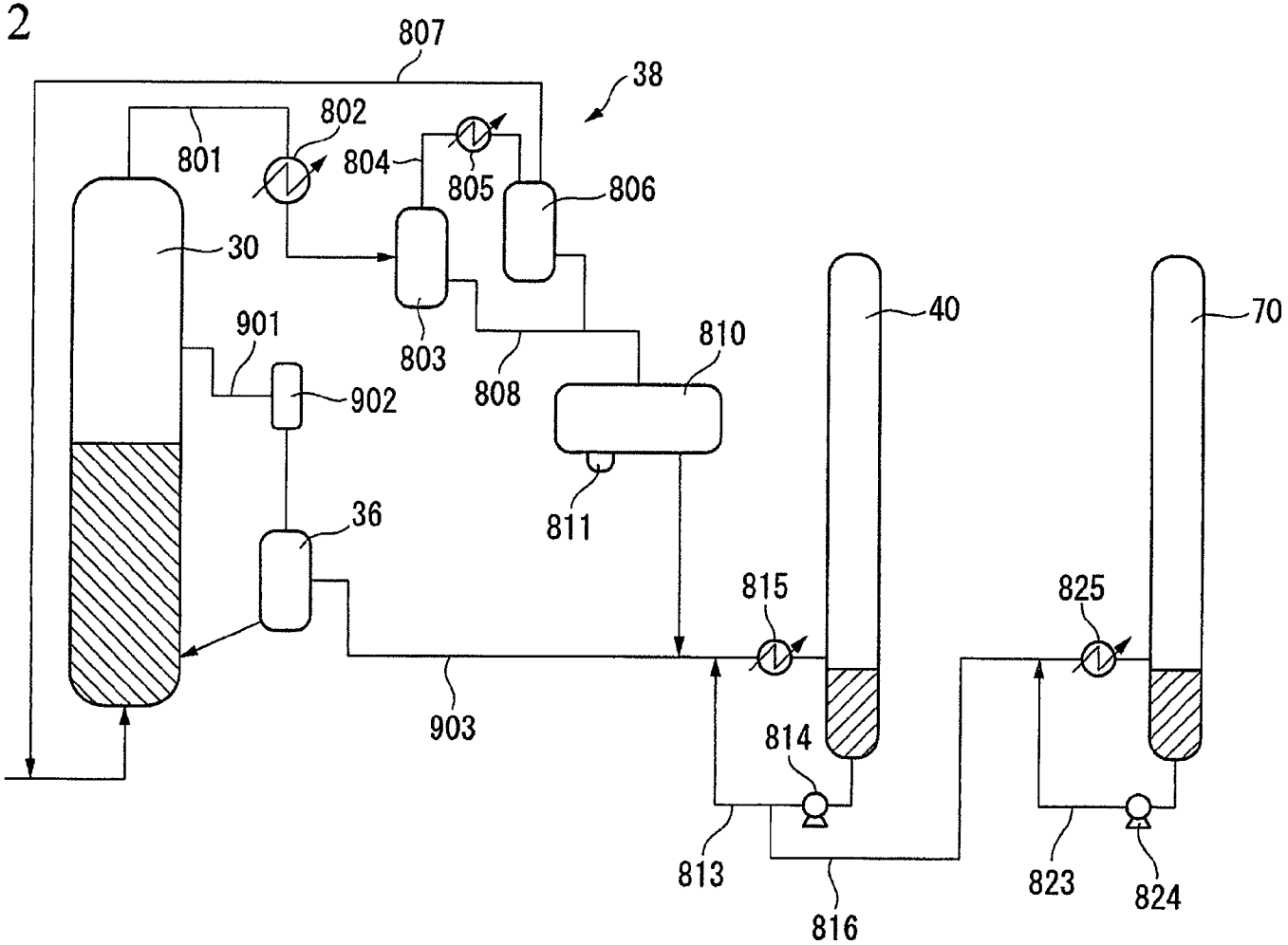
FIG. 2 is a detailed explanatory view around the fractionators (the first fractionator, the second fractionator) according to the embodiment of the present invention.
Figure 3:
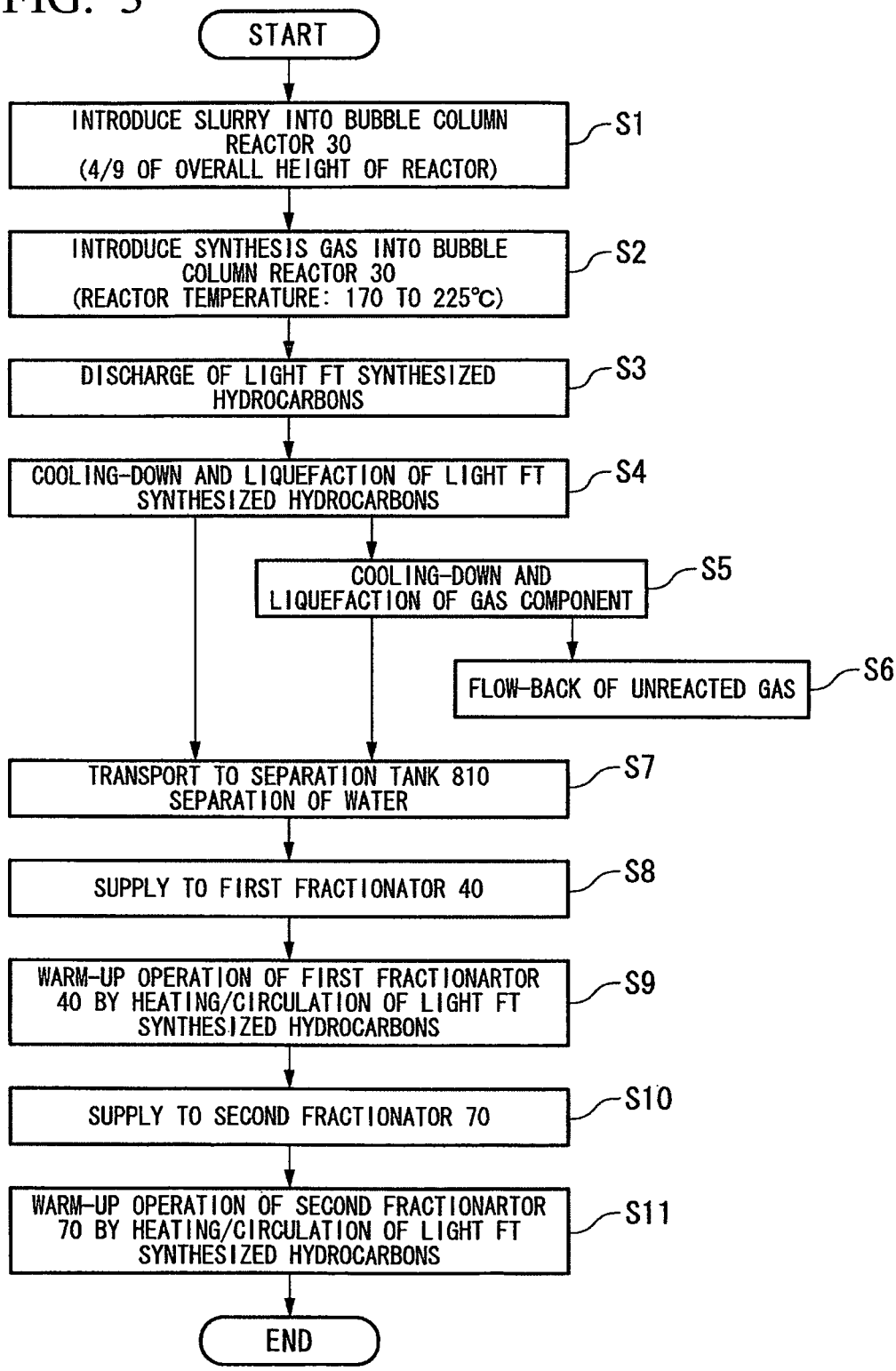
FIG. 3 is a flow chart showing a start-up method of the fractionators (the first fractionator or the second fractionator) according to the embodiment of the present invention.

Next, the bubble column reactor 30 performing the FT synthesis, the first fractionator 40, and the second fractionator 70 will be described with reference to FIGS. 2 and 3.

The top of the bubble column reactor 30 described above is provided with a discharge line 801 which discharges a gas component in the bubble column reactor 30. Further, an extraction line 901 which extracts the liquid hydrocarbons (FT synthesized hydrocarbons) in the bubble column reactor 30 is provided in the middle part of the bubble column reactor 30 (the position of about ⅔ of the overall height of the bubble column reactor 30 as shown in FIG. 2 in the present embodiment). The extraction line 901 is connected to the separator 36 via a vapor-liquid separator 902. The liquid hydrocarbons (FT synthesized hydrocarbons) separated by the separator 36 are supplied to the first fractionator 40 through a supply line 903.

The discharge line 801 is connected to a primary tank 803 via a heat exchanger 802. The upper part of the primary tank 803 is provided with a connecting line 804, and the connecting line 804 is connected to a secondary tank 806 via a heat exchanger 805. The upper part of the secondary tank 806 is provided with a flow-back line 807 which allows a gas component in the secondary tank 806 to flow back to the bottom of the bubble column reactor 30. In addition, the heat exchanger 802, the primary tank 803, the connecting line 804, the heat exchanger 805, and the secondary tank 806 constitute the vapor-liquid separator 38 in FIG. 1.

The primary tank 803 and the secondary tank 806 are connected to a separation vessel 810 via a pipe 808. The separation vessel 810 is provided with a drain system 811. The separation vessel 810 is connected to the supply line 903 which connects the separator 36 and the first fractionator 40.

The first fractionator 40 is provided with a first circulating line 813 which allows a liquid stored in the first fractionator 40 to be circulated therethrough, a first pump 814 which pumps the liquid in the circulating line 813, and a heat exchanger 815 which heats the liquid flowing through the inside of the circulating line 813.

Further, the first circulating line 813 is provided with a branch line 816, and the branch line 816 is connected to the second fractionator 70. The second fractionator 70 is provided with a second circulating line 823 which allows a liquid stored in the first fractionator 40 to be circulated therethrough, a second pump 824 which pumps the liquid in the circulating line 823, and a heat exchanger 825 which heats the liquid flowing through the inside of the circulating line 823.

Next, the start-up method of the first fractionator 40 and the second fractionator 70 having the above configuration will be described.

First, a slurry obtained by mixing liquid hydrocarbons and catalyst particles is introduced into the inside of the bubble column reactor 30 which performs the FT synthesis (S1). At this time, although the slurry is charged to a height exceeding that of the extraction line 901 (about ⅔ of the overall height of the bubble column reactor 30) during normal operation, the slurry is charged to about ⅘ of the overall height of the bubble column reactor 30 at the time of start-up. That is, at the time of start-up, the surface level (slurry level) in the bubble column reactor 30 is set to be lower than that during normal operation.

Synthesis gas is introduced into the bubble column reactor 30 to generate hydrocarbons (FT synthesized hydrocarbons) (S2). In addition, the preset temperature in the bubble column reactor 30 at this time is set to be lower than that during normal operation (210 to 240° C.), specifically 170 to 225° C., and more preferably 170 to 210° C.

The light FT synthesized hydrocarbons, which exist in a gaseous state in the bubble column reactor 30, are discharged to the outside of the bubble column reactor 30 through the discharge line 801 under the above temperature conditions (S3). At this time, since the heavy FT synthesized hydrocarbons, which exist in a liquid state in the bubble column reactor 30, are located below the height of the extraction line 901, the hydrocarbons are not extracted to the outside.

In addition, in the present embodiment, the light FT synthesized hydrocarbons are about $C_5$ to $C_{20}$, and the heavy FT synthesized hydrocarbons are about $C_{15}$ to $C_{100}$.

The light FT synthesized hydrocarbons discharged through the discharge line 801 are cooled down to, for example, about 110° C. by the heat exchanger 802 and liquefied, then stored in the primary tank 803 (S4).

A gas component which exists in a gaseous state under the above temperature conditions among the light FT synthesized hydrocarbons stored in the primary tank 803 is cooled down to about 45° C. by the heat exchanger 805 provided in the connecting line 804 and liquefied, then stored in the secondary tank 806 (S5).

Since a source gas (synthesis gas of a carbon monoxide and a hydrogen) which has not reacted within the bubble column reactor 30, is mixed into the gas component in the secondary tank 806, the unreacted source gas is made to flow back to the bubble column reactor 30 through the flow-back line 807 (S6). Further, the emission gas (flare gas) other than target products, including as the main component hydrocarbon gas having a small carbon number ($C_4$ or less), is introduced into an external combustion facility (not shown), is combusted therein, and is then emitted to the atmosphere.

Further, a drain system may be provided in the primary tank 803 and the secondary tank 806 to separate and remove the water mixed into the liquefied light FT synthesized hydrocarbons, and the light FT synthesized hydrocarbons are brought into the separation vessel 810 where the remaining water is further separated and removed (S7). Here, since the liquid light FT synthesized hydrocarbons and water exist separately within the separation vessel 810, only the water can be extracted from the drain mechanism 811 provided at the bottom of the separation vessel 810.

The light FT synthesized hydrocarbons from which water has been removed in the separation vessel 810 are supplied to the first fractionator 40 through the supply line 903 (S8). At this time, since the heavy FT synthesized hydrocarbons are not extracted from the extraction line 901, only the light FT synthesized hydrocarbons are supplied to the first fractionator 40 from the supply line 903.

Then, the light FT synthesized hydrocarbons are circulated through the inside of the first circulating line 813 by the first pump 814, and the light FT synthesized hydrocarbons are heated up to 150 to 200° C. by the heat exchanger 815 (S9). Thereby, a warm-up operation for the first fractionator 40 is performed, and the inside of the first fractionator 40 is heated to a predetermined temperature (about 320° C.).

Further, some of the light FT synthesized hydrocarbons which are circulated through the first circulating line 813 are supplied to the second fractionator 70 through the branch line 816 (S10).

Then, the light FT synthesized hydrocarbons are circulated through the inside of the second circulating line 823 by the second pump 824, and the light FT synthesized hydrocarbons are heated up to 150 to 200° C. by the heat exchanger 825 (S11). Thereby, a warm-up operation of the second fractionator 70 is performed, and the inside of the second fractionator 70 is heated to a predetermined temperature (about 310° C.).

After the first fractionator 40 and the second fractionator 70 are heated to each predetermined temperature in this way, the surface level of the heavy FT synthesized hydrocarbons in the bubble column reactor 30 goes up, and the slurry is extracted from the extraction line 901. Then, the heavy FT synthesized hydrocarbons from which the catalyst particles have been separated in the separator 36 are supplied to the first fractionator 40 through the supply line 903, and fractional distillation in the first fractionator 40 and fractional distillation in the second fractionator 70 are started.

According to the start-up method of the fractionator (the first fractionator 40 or the second fractionator 70) according to the present embodiment configured described above, the light FT synthesized hydrocarbons which exist as a gas in the bubble column reactor 30 are discharged from the discharge line 801, and are cooled down and liquefied by the heat exchangers 802 and 805, and are introduced into the first fractionator 40 and the second fractionator 70, and the light FT synthesized hydrocarbons are then circulated while being heated by the heat exchangers 815 and 825. Thus, a warm-up operation of the first fractionator 40 and the second fractionator 70 can be performed to heat them up to each predetermined temperature without using liquid hydrocarbons equivalent to gas oil obtained from an external source.

Further, since the light FT synthesized hydrocarbons obtained by the FT synthesis hardly include any sulfur components, there is no possibility of poisoning the catalysts used in the wax fraction hydrocracking reactor 50, the middle distillate hydrotreating reactor 52, and the naphtha fraction hydroprocessing reactor 54 which refine the FT synthesis hydrocarbons fractionally distilled in the first fractionator 40. Therefore, liquid fuels, such as naphtha, gas oil, and kerosene, can be efficiently obtained.

Moreover, since the light FT synthesized hydrocarbons have no problems even if being mixed into a product, it is not necessary to separate and slop out the light FT synthesized hydrocarbons.

Moreover, in the present embodiment, the surface level (slurry level) in the bubble column reactor 30 at the time of start-up is set to be lower (about 4/9 of the overall height of the bubble column reactor 30) than that during normal operation (about 2/3 of the overall height of the bubble column reactor 30). Thus, although the heavy FT synthesized hydrocarbons are not extracted to the outside until they arrive at the height of the extraction line 901 of the bubble column reactor 30, the light FT synthesized hydrocarbons which are in a gaseous state are discharged from the discharge line 801 of the bubble column reactor 30 from the initial stage of the FT reaction. That is, a time difference can be made between the start of discharge of the light FT synthesized hydrocarbons from the bubble column reactor 30, and the start of extraction of the heavy FT synthesized hydrocarbons.

Thereby, after the light FT synthesized hydrocarbons are discharged from the bubble column reactor 30, and warm-up operation of the first fractionator 40 and the second fractionator 70 is made, the heavy FT synthesized hydrocarbons are supplied to the first fractionator 40 and the second fractionator 70. As a result, fractional distillation in the first fractionator 40 and the second fractionator 70 can be reliably and efficiently performed. Further, the heavy FT synthesized hydrocarbons with a large carbon number can be kept from being mixed into the light FT synthesized hydrocarbons, and the fluidity of the light FT synthesized hydrocarbons can be secured.

Further, as a slurry produced by mixing liquid hydrocarbons and catalyst particles obtained from external sources is charged into the bubble column reactor 30 at the time of the start-up of the bubble column reactor 30, the amount of liquid hydrocarbons required to produce the slurry can also be reduced.

Further, in the present embodiment, the preset temperature in the bubble column reactor 30 is set to be 170 to 225° C., and more preferably 170 to 210° C., and is set to be lower than a preset temperature during normal operation (210 to 240° C.). Thus, the boiling point of the light FT synthesized hydrocarbons which exist in a gaseous state in the bubble column reactor 30 is lowered, and the light FT synthesized hydrocarbons with a small carbon number are obtained. Accordingly, the fluidity of the light FT synthesized hydrocarbons can be improved and warm-up operation of the first fractionator 40 and the second fractionator 70 can be performed well.

Further, in the present embodiment, the secondary tank 806 is provided with a flow-back line 807 which removes the unreacted source gas from the light FT synthesized hydrocarbons, and allows the unreacted source gas to flow back to the bubble column reactor 30. Thus, the source gas (synthesis gas of carbon monoxide and hydrogen) which has not reacted within the bubble column reactor 30 can be made to react within the bubble column reactor 30 again, and the productivity of the hydrocarbon by the FT synthesis can be improved.

Moreover, in the present embodiment, the separation vessel 810 which removes the water included in the light FT synthesized hydrocarbons is provided. Thus, the water (steam), a byproduct in the bubble column reactor 30, can be removed from the light FT synthesized hydrocarbons, and mixing of the water into the first fractionator 40 and the second fractionator 70 can be prevented.

Although the embodiments of the present invention have been described hitherto in detail with reference to the drawings, concrete configurations are not limited to the embodiments, and the present invention also includes design changes which do not depart from the spirit of the present invention.

Figure 4:
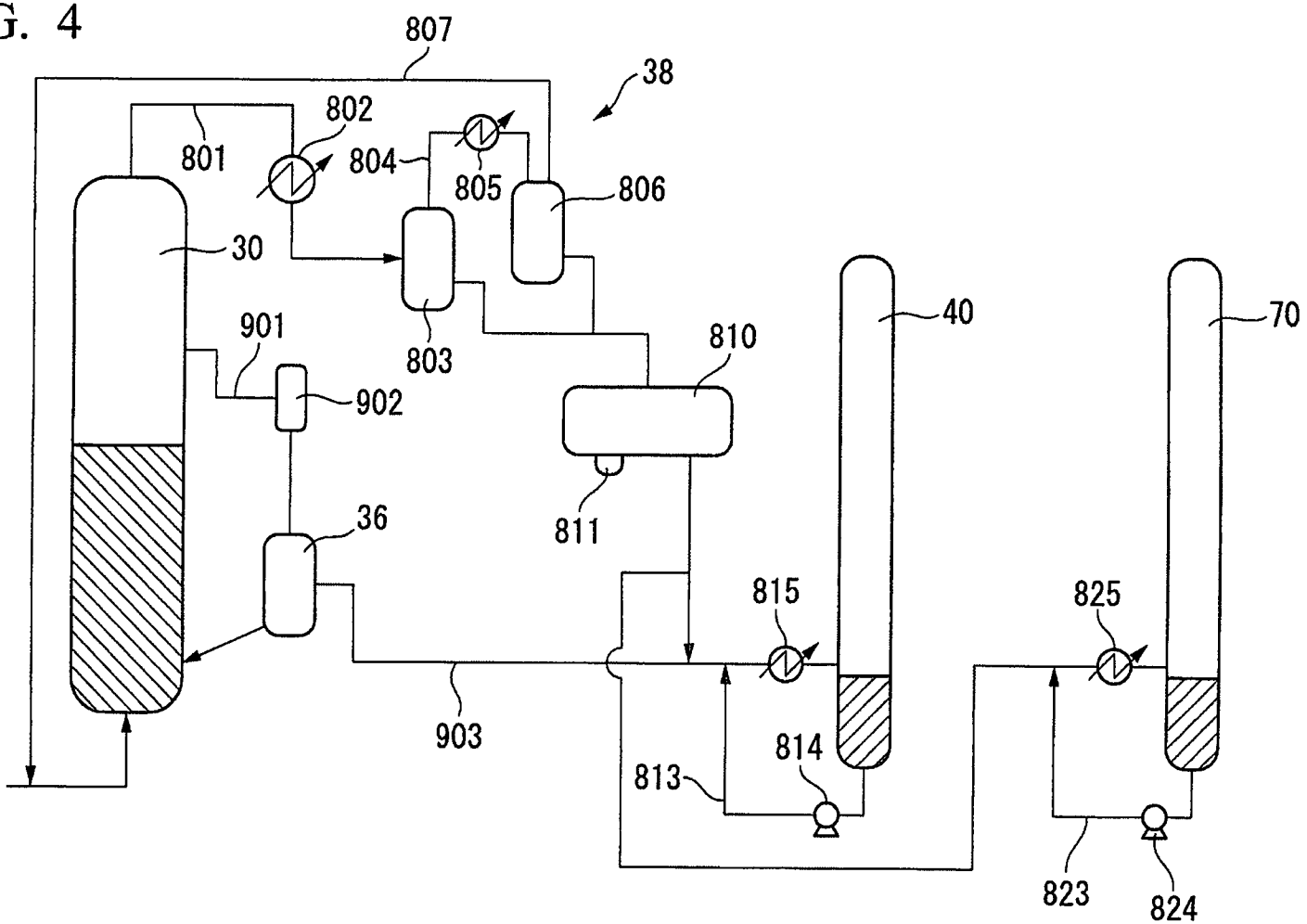
FIG. 4 is a detailed explanatory view around fractionators (a first fractionator, a second fractionator) according to another embodiment of the present invention.

For example, although the configuration in which the first circulating line 813 of the first fractionator 40 is provided with the branch line 816, and the light FT synthesized hydrocarbons are supplied to the second fractionator 70 has been described, the present invention is not limited thereto, and as shown in FIG. 4, a configuration in which the light FT synthesized hydrocarbons are supplied to the second fractionator 70 directly from the separation vessel 810 may be adopted.

Further, a configuration in which only one of the first fractionator 40 and the second fractionator 70 is warm-up operated with the light FT synthesized hydrocarbons may be adopted.

Further, in the present embodiment, the configuration in which a time difference is provided between the discharge of the light FT synthesized hydrocarbons and the extraction of the heavy FT synthesized hydrocarbons by making the surface level (slurry surface) in the bubble column reactor 30 at the time of start-up lower than that during normal operation. However, the present invention is not limited thereto. For example, a storage tank may be disposed on the extraction line 901 for the slurry, and a time difference may be provided between the discharge of the light FT synthesized hydrocarbons and the extraction of the heavy FT synthesized hydrocarbons.

Further, although description has been made that the light FT synthesized hydrocarbons discharged from the discharge line 801 are cooled down in two steps by the two heat exchangers 802 and 805, the present invention is not limited thereto, and the light FT synthesized hydrocarbons may be cooled down by one heat exchanger.

Moreover, although description has been made that the separation vessel 810 is provided, the separation vessel 810 may not be provided. However, since water can be removed by providing the separation vessel 810, and contamination in the fractionator (the first fractionator 40 or the second fractionator 70) can be prevented, it is preferable to provide the separation vessel 810.

Moreover, the temperature range is not limited to that exemplified in the present embodiment, and it is preferable that the temperature range can be suitably set in consideration of the operation conditions. However, in the circulating line (the first circulating line 813 and the second circulating line 823), it is necessary to heat the light FT synthesized hydrocarbons to be circulated to a temperature at which the light FT synthesized hydrocarbons are not solidified.

INDUSTRIAL APPLICABILITY

According to the start-up method of the fractionator of the present invention, when a warm-up operation of a fractionator which fractionally distills the FT synthesized hydrocarbons obtained by the FT synthesis reaction is performed, the fractionator can be warm-up operated without using the hydrocarbons equivalent to gas oil obtained from an external source, and high-quality liquid fuels can be obtained with no concern of the incorporation of sulfur (S) components.

DESCRIPTION OF REFERENCE NUMERALS

1: LIQUID-FUEL SYNTHESIZING SYSTEM (HYDROCARBON SYNTHESIS REACTION SYSTEM)
30: BUBBLE COLUMN REACTOR (FT REACTOR)
40: FIRST FRACTIONATOR (FRACTIONATOR)
70: SECOND FRACTIONATOR (FRACTIONATOR)

The invention claimed is:

1. A start-up method of a fractionator which fractionally distills FT synthesized hydrocarbons produced by the Fischer-Tropsch synthesis reaction, the method comprising:

discharging light FT synthesized hydrocarbons which exist in a gaseous state in an FT reactor performing the Fischer-Tropsch synthesis reaction from the FT reactor to a vapor-liquid separator;

cooling down the light FT synthesized hydrocarbons discharged from the FT reactor for liquefaction;

supplying the liquefied light FT synthesized hydrocarbons to the fractionator;

heating the liquefied light FT synthesized hydrocarbons; and circulating the heated light FT synthesized hydrocarbons to the fractionator via a circulating line, thereby heating the fractionator.

2. The start-up method of a fractionator according to claim 1, wherein the discharging of the light FT synthesized hydrocarbons from the FT reactor is started before extracting of a heavy FT synthesized hydrocarbons which exist in a liquid state in the FT reactor.

3. The start-up method of a fractionator according to claim 2, wherein the surface level in the FT reactor at the time of start-up is set to be lower than the surface level in the FT reactor during normal operation.

4. The start-up method of a fractionator according to claim 1, wherein an unreacted source gas mixed into the light FT synthesized hydrocarbons which exist in a gaseous state in the FT reactor is discharged from the FT reactor, and the unreacted source gas is flowed back to the FT reactor.

5. The start-up method of a fractionator according to claim 1, further comprising removing water included in the light FT synthesized hydrocarbons.

* * * * *

UNITED STATES PATENT AND TRADEMARK OFFICE

CERTIFICATE OF CORRECTION

PATENT NO. : 8,685,212 B2
APPLICATION NO. : 12/998199
DATED : April 1, 2014
INVENTOR(S) : Tanaka et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 399 days.

Signed and Sealed this
Twenty-ninth Day of September, 2015

Michelle K. Lee

Michelle K. Lee
*Director of the United States Patent and Trademark Office*